US012710031B2

(12) United States Patent
Ebrahimi et al.

(10) Patent No.: US 12,710,031 B2
(45) Date of Patent: Aug. 18, 2026

(54) SMOOTHING PUMP RATE DURING TRANSITION

(71) Applicant: Halliburton Energy Services, Inc., Houston, TX (US)

(72) Inventors: Behrouz Ebrahimi, Houston, TX (US); Zhijie Sun, Houston, TX (US); Erik Lee, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 96 days.

(21) Appl. No.: 18/515,946

(22) Filed: Nov. 21, 2023

(65) Prior Publication Data

US 2025/0163907 A1 May 22, 2025

(51) Int. Cl.

| | |
|---|---|
| ***F04B 23/06*** | (2006.01) |
| ***E21B 43/26*** | (2006.01) |
| ***F04B 15/02*** | (2006.01) |
| ***F04B 49/20*** | (2006.01) |
| *F04B 49/06* | (2006.01) |

(52) U.S. Cl.

CPC ..... *F04B 23/06* (2013.01); *E21B 43/2607* (2020.05); *F04B 15/02* (2013.01); *F04B 49/20* (2013.01); *F04B 49/065* (2013.01); *F04B 2205/09* (2013.01); *F04B 2207/041* (2013.01)

(58) Field of Classification Search

CPC ..... F04B 23/06; F04B 15/02; F04B 49/065; F04B 49/20; F04B 2205/09; F04B 2207/041

USPC ..... 417/4, 5, 426

See application file for complete search history.

(56) References Cited

U.S. PATENT DOCUMENTS

| | | | | |
|---|---|---|---|---|
| 9,121,397 | B2 * | 9/2015 | Marica | F04B 11/00 |
| 10,851,638 | B2 | 12/2020 | Payne et al. | |
| 11,649,817 | B2 * | 5/2023 | Bagulayan | F04B 49/065 417/44.1 |
| 11,649,820 | B2 | 5/2023 | Yeung et al. | |
| 11,939,853 | B2 * | 3/2024 | Yeung | E21B 43/2607 |
| 12,467,348 | B2 * | 11/2025 | Yeung | F04B 49/20 |
| 2020/0141219 | A1 | 5/2020 | Oehring et al. | |
| 2021/0040830 | A1 | 2/2021 | Mu et al. | |
| 2022/0003229 | A1 | 1/2022 | Mu et al. | |

* cited by examiner

*Primary Examiner* — Charles G Freay

(74) *Attorney, Agent, or Firm* — DeLizio, Peacock, Lewin and Guerra, LLP

(57) ABSTRACT

A method for controlling one or more frac pumps of a fracturing spread. The method comprises adjusting a total pump rate of one or more target pumps of the frac pumps to achieve a total rate setpoint for the frac pumps. The method comprises activating one or more trim pumps for an additional pump rate to compensate for a total rate dip occurring when the total pump rate of the one or more target pumps is adjusted.

8 Claims, 5 Drawing Sheets

SMOOTHING PUMP RATE DURING TRANSITION

TECHNICAL FIELD

This disclosure relates generally to the field of hydraulic fracturing operations of a subsurface formation and more particularly to the field of smoothing pump rates during transition in hydraulic fracturing operations.

BACKGROUND

In hydrocarbon recovery operations, fluid and sand may be pumped into a wellbore to hydraulically fracture a subsurface formation. A fracturing spread may include fracturing pumps configured to pump fluid and sand into the wellbore. The pump rate and pressure from the fluid may fracture the subsurface formation, creating a conduit for the fluid in the subsurface formation to flow to the wellbore and ultimately to the surface. Sand may be pumped with the fluid and placed into the fractures to support said fractures. A plurality of pumps may be utilized to generate flow rates and pressure sufficient for fracturing the subsurface formation and/or transporting sand, via fluid, to the fractures.

BRIEF DESCRIPTION OF THE DRAWINGS

Implementations of the disclosure may be better understood by referencing the accompanying drawings.

DESCRIPTION

Figure 1:
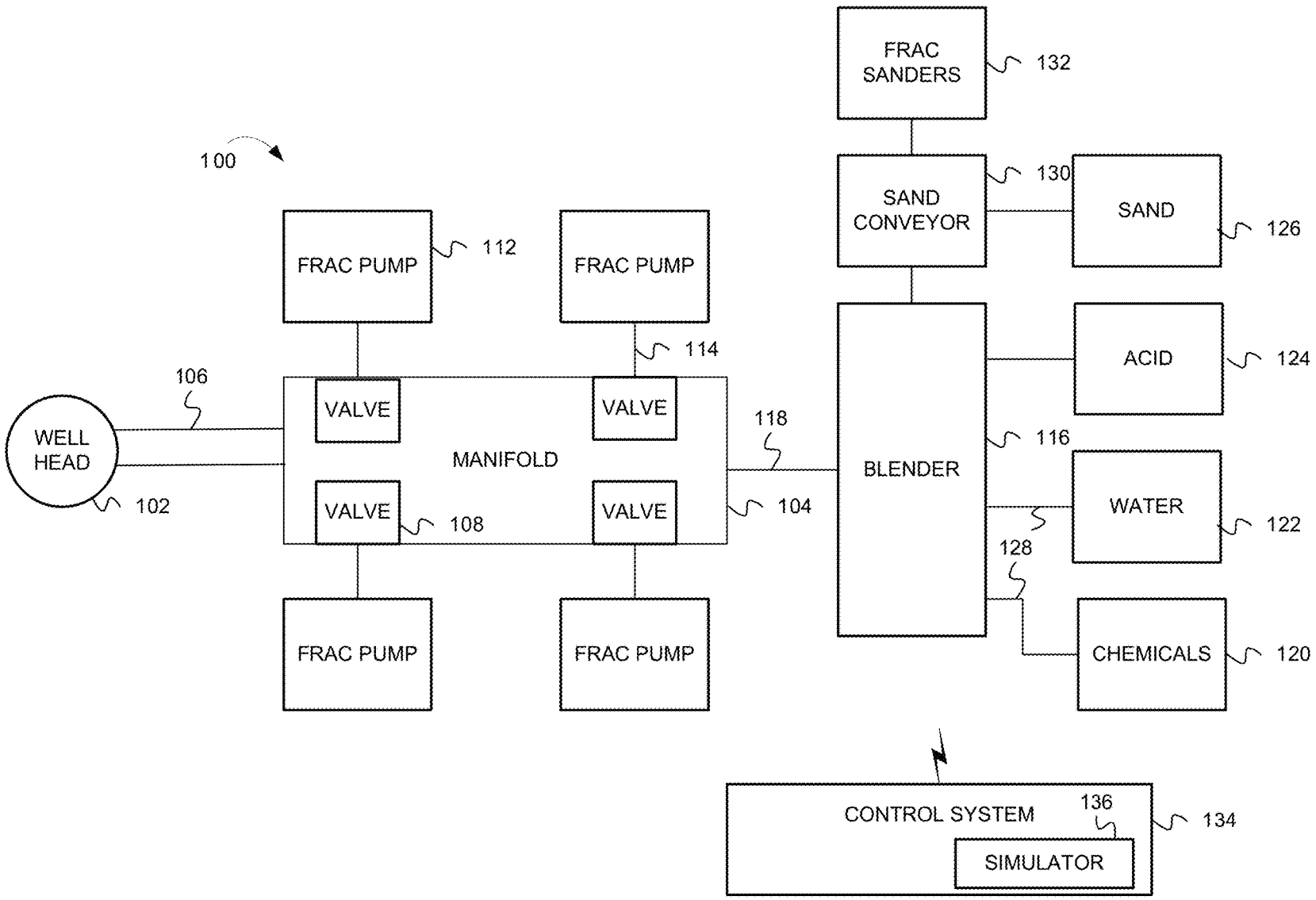
FIG. 1 is a block diagram illustrating a fracturing spread configured for hydraulically fracturing subsurface formations in one or more wells, according to some implementations.

The description that follows includes example systems, methods, techniques, and program flows that embody aspects of the disclosure. However, it is understood that this disclosure may be practiced without these specific details. For instance, this disclosure refers to selecting trim pumps to compensate for the rate dip of target pumps during hydraulic fracturing operations. Aspects of this disclosure can also be applied to any point prior to, during, or after hydraulic fracturing operations. For clarity, some well-known instruction instances, protocols, structures, and operations have been omitted.

Example implementations relate to smoothing pump rates of a fracturing spread during hydraulic fracturing operations. A fracturing spread may include one or more fracturing pumps ("frac pumps"), such as frac pumps powered by a diesel engine and/or electric frac pumps, configured to pump fluid and/or sand (such as a slurry of water, sand, chemicals, etc.) at a specified rate to fracture a subsurface formation. In some implementations, one or more frac pumps may increase their respective pump rate to achieve the desired pump rate of the fracturing spread. During the increase or decrease in pump rate, a frac pump powered by a diesel engine may have to shift gears (i.e., shift to a higher or lower gear) in order to achieve the desired pump rate. When a gear shift occurs, the pump rate of the respective frac pump may experience a rate dip. When a frac pump experiences a rate dip, the frac pump may temporarily deliver a lower pump rate than the desired pump rate which may result in a less efficient well stimulation process. For example, when a rate dip occurs, the desired treating pressure may not be maintained during the hydraulic fracturing process which may result in issues such as under stimulating the subsurface formation, damage to the wellbore, damage to the frac pump, underperformance of the wellbore when brought online to produce, etc.

Several factors may contribute to rate dip in a frac pump powered by a diesel engine. Some examples of factors contributing to rate dip include transmission inertia, pressure transient, pump response time, and control system dynamics. When shifting up to increase pump rate, the inertia of the transmission system of a frac pump may cause a temporary delay resulting in an undesired rate dip. Pressure fluctuations and/or transients during a gear shift may affect the frac pump's ability to deliver a consistent flow rate, resulting in a rate dip. Slower response time of a frac pump during a gear shift may result in a rate dip. The control system responsible for regulating a frac pump's speed or load may have inherent dynamics or lags that may contribute to rate dip if not adequately accounted for in the control system design.

In some implementations, one or more target pumps and one or more trim pumps of the fracturing spread may be identified and utilized to mitigate rate dip. The fracturing spread may include one or more frac pumps. For example, the fracturing spread may include one or more frac pumps powered by diesel engines, electric frac pumps, etc. In some implementations, a total rate setpoint may be determined for the fracturing spread. The total rate setpoint may be a pump rate higher or lower than the current pump rate of the fracturing spread, requiring an increase or decrease in the pump rate of the fracturing spread, respectively. One or more target pumps may be identified from the frac pumps to maintain the total rate setpoint. A target pump may be a frac pump powered by a diesel engine that may need to shift gears (e.g., upshift or downshift) to adjust the respective pump rate to achieve and maintain a respective rate setpoint. The aggregate of the respective rate setpoint adjustments may be approximately equal to the total rate setpoint adjustment from the current pump rate of the fracturing spread. For example, if the current pump rate is 70 barrels per minute (BPM) and the total rate setpoint is 80 BPM, the total rate setpoint adjustment may be 10 BPM. Accordingly, the aggregate of respective pump rates adjustments of the target pumps may be 10 BPM. When a target pump shifts gears to adjust the respective pump rate to achieve the respective rate setpoint, a rate dip may occur. In some implementations, the rate dip for each of the target pumps may be determined. The rate dip may be determined prior to and/or during hydraulic fracturing operations. The aggregate of rate dips from each respective target pump may be the total rate dip.

In some implementations, one or more trim pumps may be identified from the frac pumps of the fracturing spread. The one or more trim pumps may be pumps utilized to compensate for the rate dip generated by the target pumps. Trim pumps may be frac pumps that may have the capacity to adjust their respective pump rate without shifting gears. For example, a trim pump may increase or decrease pump rate while remaining in the same gear. The aggregate of additional pump rates from the one or more trim pumps may be similar to the total rate dip of the one or more target pumps such that the additional pump rate of the trim pumps compensates for the total rate dip. For example, if the target pumps generate a rate dip of 5 BPM, the trim pumps may temporarily increase their total pump rate to 5 BPM, without a gear shift, to compensate for the rate dip.

In some implementations, the one or more target pumps and the one or more trim pumps may be activated. When activated, respective pump rates of the one or more target rates are adjusted to the respective rate setpoints and the respective pump rates of the one or more trim pumps are adjusted to compensate for the total rate dip generated by the target rate pumps. Accordingly, the overall pump rate of the fracturing spread may be flat and rate dip may be eliminated or mitigated. The utilization of target pumps and trim pumps may be implemented during hydraulic fracturing operations such as when ramping up/down (i.e., increasing/decreasing pump rate, respectively), offlining one or more frac pumps during the flushing stage at the end of hydraulic fracturing operations, and replacing unhealthy frac pumps during hydraulic fracturing operations.

Example System

FIG. 1 is a block diagram illustrating a fracturing spread configured for hydraulically fracturing subsurface formations in one or more wells, according to some implementations. The fracturing spread described herein may be part of a larger system for drilling and fracturing well. The fracturing spread 100 may include a wellhead 102 that is connected to a wellbore. The wellbore (not shown) may be fluidically connected to one or more subsurface formations for the purpose of hydrocarbon recovery. Although FIG. 1 shows only one wellhead 102, there may be any suitable number of wellheads 102 and wellbores.

The wellhead 102 may be connected to a manifold 104 via piping 106. The piping 106 may include one or more pipes between the wellhead 102 and the manifold 104. The manifold 104 may include a plurality of valves 108 and various internal piping (not shown) for performing hydraulic fracturing operations.

The manifold 104 may be connected to one or more fracturing pumps ("frac pumps") 112. The manifold 104 also may be connected to a blender 116 via piping 118. The blender 116 may be connected via piping 128 to one or more chemical containers 120, water containers 122, and acid containers 124. The blender 116 also may be connected to a sand conveyor 130, where the sand conveyor 130 may be connected to the container of fracturing sanders 132.

The fracturing spread 100 also may include a control system 134 configured to control one or more of the components of the fracturing spread 100. In some implementations, the control system 134 directly controls the equipment. However, the control system 134 may interact with various equipment controllers (not shown) and sensors to perform operations of the fracturing spread 100. For example, the fracturing spread 100 may include separate controllers (not shown) for the frac pumps 112, manifold 104, blender 116, and wellhead 102. The control system 134 may transmit commands to these separate controllers to change configurations (such as valve position, flow rate, chemical concentration, etc.) of the frac pumps 112, manifold 104, blender 116, chemical containers 120, etc.

The control system 134 may include a simulator 136. The simulator 136 may simulate operations (such as hydraulic fracturing operations) performed by various configurations of the fracturing spread 100. For example, the simulator 136 may determine operations to mitigate rate dip. As a more specific example, the simulator 136 may identify target frac pumps within the frac pumps 112. The simulator 136 may determine the rate dip of the target pumps and identify trim pumps within the frac pumps 112 to compensate for the rate dip. The simulator 136 may perform the simulation before the fracturing spread 100 is operational. By simulating particular operations of the fracturing spread 100, the control system 134 may determine that certain operations may mitigate rate dip before the operations commence.

The control system 134 also may utilize the simulator 136 while the fracturing spread 100 is performing hydraulic fracturing operations. For example, as the fracturing spread 100 performs operations for hydraulic fracturing, the control system 134 may identify target pumps within the frac pumps 112 to achieve and maintain a total rate setpoint. The control system 134 may also determine the total rate dip of the target pumps and identify trim pumps to compensate for the rate dip. For example, the control system 134 may determine the rate dip of target pumps when the pump rates of the target pumps are adjusted to maintain the total rate setpoint. Hence, the control system 134 may identify trim pumps and adjust the respective pump rates of the trim pumps to compensate for the rate dip of the target pumps. The control system 134 may send the command to components of the fracturing spread 100 (such as a valve controller) to execute the command by implementing pump rate adjustments to the target pumps and/or trim pumps. As another example of real-time simulation, the control system 134 may continuously detect rate dips and run simulations to identify trim pumps to compensate for the rate dip.

Example Operations

Examples operations are now described.

Figure 2:
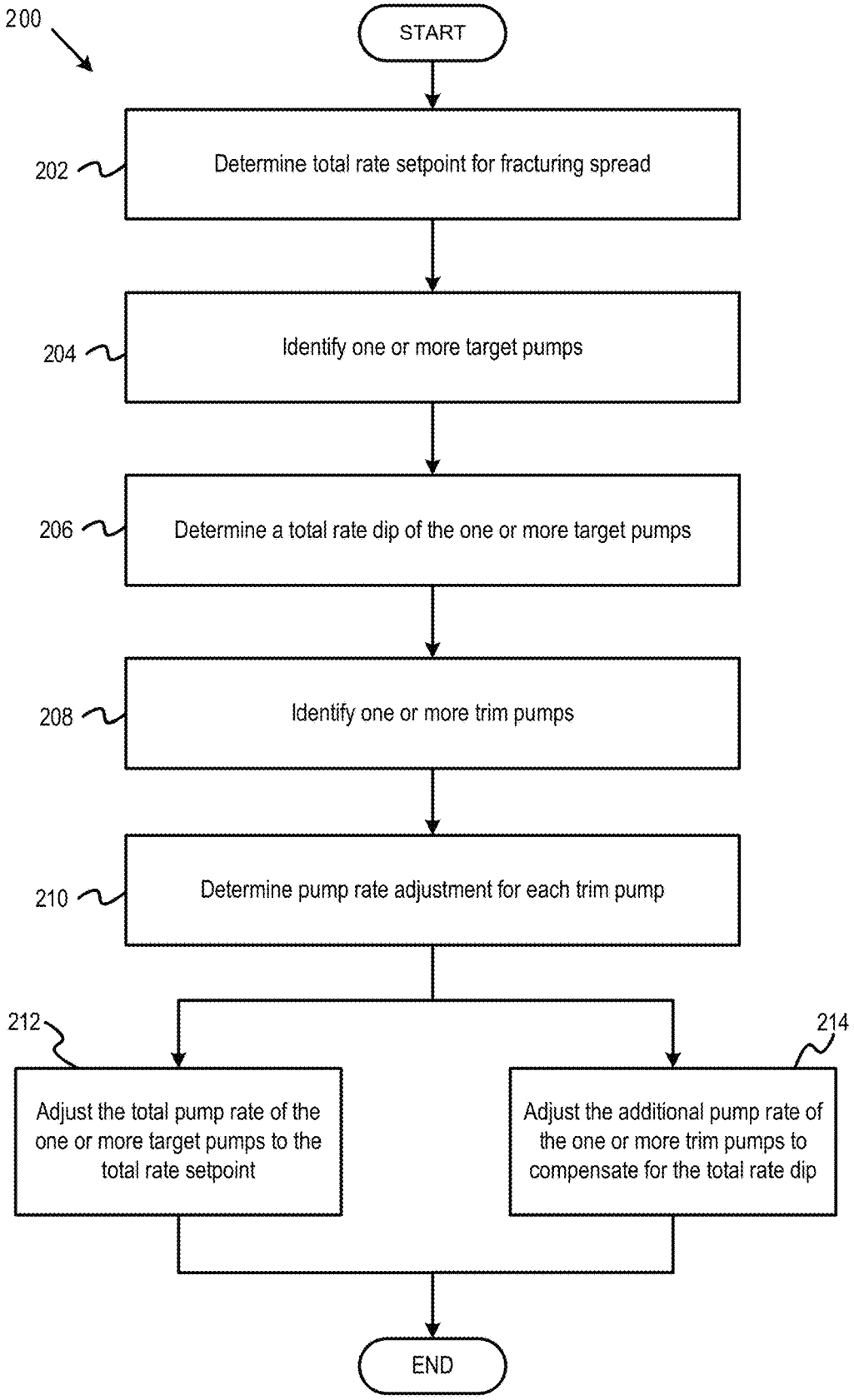
FIG. 2 is a flowchart depicting example operations for mitigating rate dip of a fracturing spread, according to some implementations.

FIG. 2 is a flowchart depicting example operations for mitigating rate dip of a fracturing spread, according to some implementations. FIG. 2 includes a flowchart 200 identifying one or more target pumps and one or more trim pumps to mitigate rate dip. The operations of the flowchart 200 may be repeatedly performed during hydraulic fracturing operations and/or prior to hydraulic fracturing operations. For example, the operations may be run continuously when adjusting the pump rate of the fracturing spread, prior to adjusting the pump rate of the fracturing spread, etc. Operations of flowchart 200 of FIG. 2 are described in reference to the control system 134 of FIG. 1. Additionally, the operations of flowchart 200 are described in reference to the frac pumps 112 of FIG. 1. Operations of the flowchart 200 start at block 202.

At block 202, the control system 134 may determine a total rate setpoint for the fracturing spread. The total rate setpoint may be the new pump rate of the fracturing spread. The total rate setpoint may be greater than or less than the current pump rate of the fracturing spread. For example, if a fracturing spread is currently pumping 70 BPM at the current stage, and the next stage in a fracturing plan calls for 80 BPM, the total rate setpoint may be 80 BPM. Accordingly, a total rate setpoint adjustment may be the difference between the current pump rate of the fracturing spread and the total rate setpoint (e.g., 10 BPM in the previous example).

Figure 3:
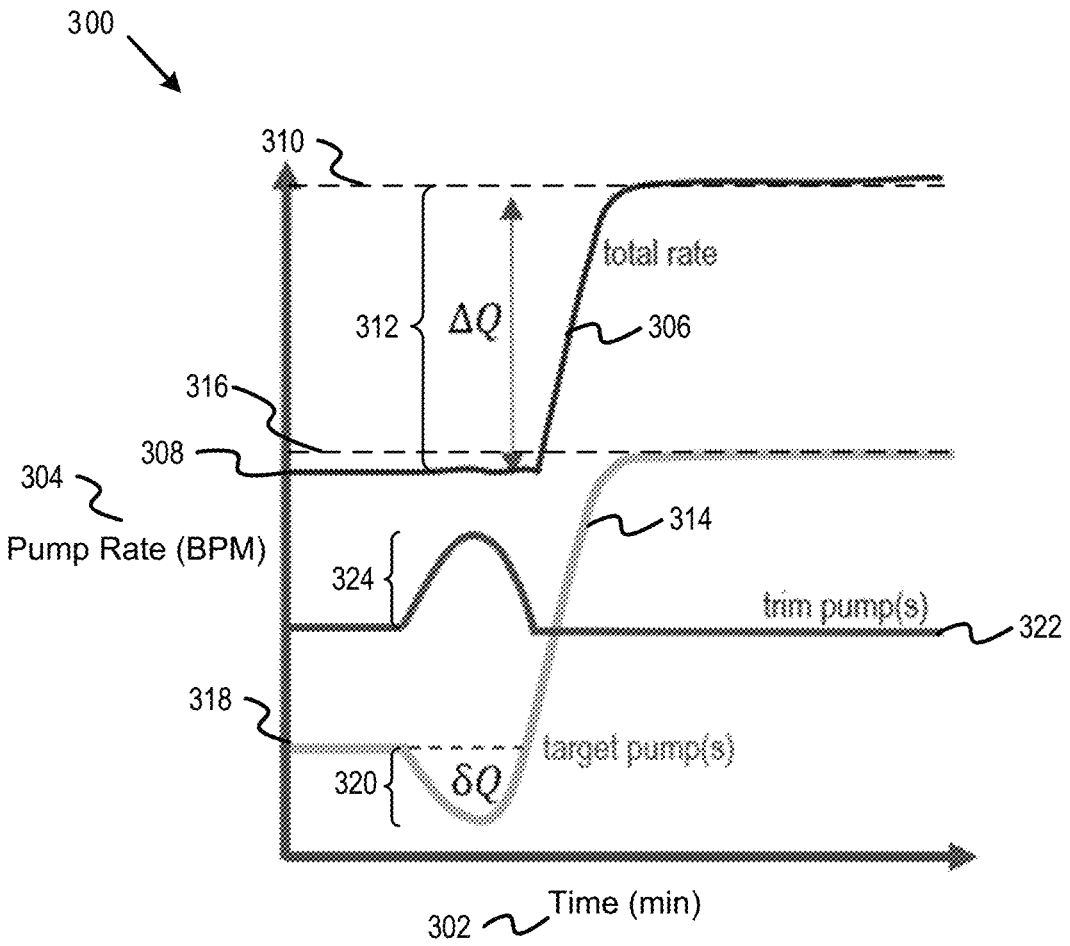
FIG. 3 is a chart depicting pump rate profiles of a fracturing spread, according to some implementations.

To help illustrate, FIG. 3 is a chart depicting pump rate profiles of a fracturing spread, according to some implementations. In particular, FIG. 3 includes a chart 300 with an x-axis 302 and a y-axis 304. The x-axis 302 is the time having units in minutes (min). The y-axis 304 is the pump rate having units in barrels per minute (BPM). The total pump rate 306 is the pump rate of the fracturing spread over time. A total rate setpoint 310 may be set based on factors such as the fracturing design of a wellbore, surface treating pressure during the stage, etc. The difference between the total rate setpoint 310 and the current pump rate 308 may be the total pump rate adjustment 312. The chart 300 depicts the total rate setpoint 310 greater than the current pump rate 308. In some implementations the total rate setpoint 310 may be less than the current pump rate 308. The current pump rate 308 and the total rate setpoint 310 may be accomplished by the aggregate of respective pump rates from one or more frac pumps within the fracturing spread.

At block 204, the control system 134 may identify one or more target pumps. A target pump may be an operating pump of the fracturing spread selected and assigned a respective rate setpoint different than the current respective pump rate. The aggregate of respective rate setpoints from the selected pumps may be similar to the total rate setpoint adjustment. For example, a fracturing spread includes 20 frac pumps and the fracturing spread has a current pump rate of 60 BPM. The total rate setpoint may be 80 BPM. Accordingly, the total rate point adjustment may be 20 BPM (difference between 80 BPM and 60 BPM). 10 frac pumps may be selected as target pumps to achieve and maintain the total rate setpoint of 80 BPM. Each of the 10 target pumps are assigned a respective rate setpoint such that the aggregate of the respective rate setpoints may result in 20 BPM adjustment to achieve the total rate setpoint of 80 BPM. Each target pump may be assigned similar and/or different respective rate setpoints. For instance, each target pump may be assigned a rate setpoint 2 BPM higher than its current respective pump rate to achieve the total rate setpoint of 80 BPM. To help illustrate, the chart 300 of FIG. 3 includes the target pump rate 314 for the target pumps. The target pump rate setpoint 316 may be the aggregate of the respective rate setpoints assigned to each target pump. The difference between the target pump rate setpoint 316 and the current target pump rate 318 may be the pump rate adjustment needed to achieve the total pump rate adjustment 312.

When the target pumps adjust their current pump rate, a gear shift may take place, i.e., a target pump may upshift or downshift to achieve their respective rate setpoint. For example, if a target pump is assigned a rate setpoint increase of 2 BPM, the target pump may need to upshift one or more gears to achieve an increased pump rate of 2 BPM from its current pump rate. In some implementations, frac pumps may be selected as target pumps because the respective frac pumps do not have the capacity to adjust their respective pump rate without a gear shift. When a gear shift occurs, a rate dip may occur. In some implementations, one or more frac pumps that with decreasing pump rates may be selected as target pumps. For example, one or more frac pumps within the fracturing spread may increase their respective pump rate while other frac pumps within the fracturing spread decrease their respective pump rate. Although the frac pumps may not shift gears to decrease pump rates, the one or more pumps with decreasing pump rates may be selected as target pumps because the pump rate decrease may occur faster than a pump rate increase. By selecting these frac pumps as the target pumps, the time-derivative of rate drop may be compensated by trim pumps (as described below).

At block 206, the control system 134 may determine a total rate dip of the one or more target pumps. The respective rate dip for each of the target pumps may be determined. The rate dip for each target pump may be determined utilizing a physics-based model and/or a data-driven model. In some implementations, each rate dip may be determined prior to adjusting the pump rate of the target pumps and/or while the pump rates of the target pumps are being adjusted (i.e., in real time). For example, the rate dip of a target pump may be determined while the target pump shifts gears to increase the pump rate.

Figure 4:
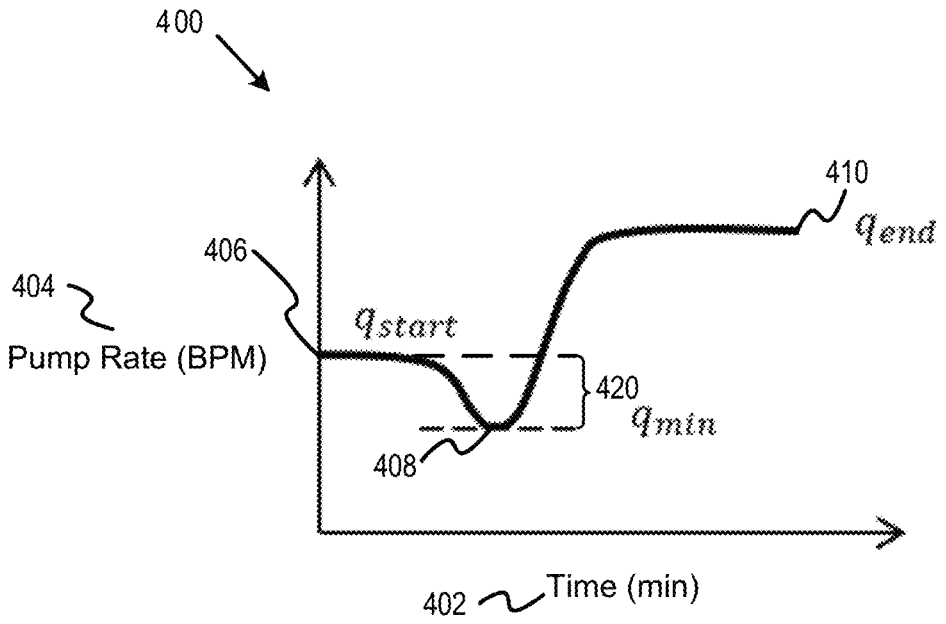
FIG. 4 is a chart depicting the rate dip of a frac pump, according to some implementations.

To help illustrate, FIG. 4 is a chart depicting the rate dip of a frac pump, according to some implementations. In particular, FIG. 4 includes a chart 400 with an x-axis 402 and a y-axis 404. The x-axis 402 is the time having units in minutes (min). The y-axis 404 is the pump rate having units in barrels per minute (BPM). The rate dip 420 may be defined as the temporary drop in flow rate from the pump, i.e., the lesser of the differences between the minimum pump rate 408 and the starting pump rate 406/ending pump rate 410. For example, the rate dip 420 for a frac pump, represented by δq (using Equation 1 below), may be defined as follows:

$$\delta q = \min(q_{start} - q_{min}, q_{end} - q_{min}) \tag{1}$$

where $q_{start}$ is the starting pump rate 406, $q_{end}$ is the ending pump rate 410, and $q_{min}$ is the minimum pump rate 408.

The summation of respective rate dips for each target pump may be the total rate dip. For example, in reference to the chart 300 of FIG. 3, the total rate dip 320 for the target pumps may be the aggregate of rate dips from the target pumps.

At block 208, the control system 134 may identify one or more trim pumps. A trim pump may be a frac pump that may adjust their pump rate without a gear change. For example, a trim pump may be a frac pump that can increase pump rate at the same gear. The trim pumps may be part of the operations pumps within the fracturing spread and/or specific pumps utilized for trimming purposes to mitigate rate dip. The trim pumps may be selected based on the pump type. For example, trim pumps may be a pump driven by an electric motor whose fast response and transmission-free structure may make it ideal for trimming purposes. The trim pumps may be selected based on historical performance of the frac pumps. For example, frac pumps free of faults and/or having the fastest response time to commands (e.g., commands from the control system 134) may be selected as trim pumps. In some implementations, the historical data may be analyzed prior to hydraulic fracturing operations to determine the preference of trim pumps prior to beginning hydraulic fracturing operations. In some implementations, the historical data may be analyzed during hydraulic fracturing operations to determine the preference of trim pumps in real time. The trim pumps may be selected based on the response time. For example, a frac pump with a lower gear than another frac pump will be selected as a trim pump due to the higher torque of the frac pump in the lower gear generating a faster response time.

At block 210, the control system 134 may determine pump rate adjustments for each trim pump. Each trim pump may be assigned a rate adjustment profile such that the aggregate of rate adjustments from the trim pumps generates an additional pump rate that may compensate for the total rate dip of the one or more target pumps. A rate adjustment profile of a trim pump may include a temporary pump rate adjustment. For example, a rate adjustment profile may include a temporary pump rate increase for a specified time period, and may then return to the original pump rate prior to the pump rate increase. The rate adjustments may be assigned based on the respective trim pumps. In some implementations, the rate adjustments may be uniform across the trim pumps. For example, a total rate dip may be determined to be 5 BPM. If 5 trim pumps are identified, each of the trim pumps may be assigned a rate adjustment of 1 BPM to compensate for the 5 BPM rate dip. In some implementations, the rate adjustments to trim pumps may not be uniform across the trim pumps. For example, different trim pumps may be assigned different rate adjustments to compensate for the total rate dip. In some implementations, the assigned rate adjustments to the trim pumps may be weighted based on trim pump properties such as available capacity of the trim pump without shifting gears, historical performance, etc. If a trim pump has a higher capacity than another trim pump, then the trim pump with the higher capacity may be assigned a greater pump rate adjustment than the trim pump with the lower capacity. The rate adjustments assigned to each trim pump may be assigned based on any suitable factor such as pump rate capacity, current gear, historical performance, pump type, etc.

In some implementations, the additional pump rate of the one or more trim pumps may be similar to the total rate dip. For example, with reference to FIG. 3, the additional pump rate 324 of the trim pumps 322 may be approximately equal to the total rate dip 320 such that the total pump rate 306 is smooth when adjusting to the total rate setpoint 310. In some implementations, the additional pump rate of the one or more trim pumps may include a prediction of trajectory of the total rate dip in future hydraulic fracturing operations.

The operations of the flowchart now proceed to block 212 and block 214. The operations of blocks 212 and 214 may be performed in parallel or in series (e.g., block 212 first, then block 214). For example, block 212 and block 214 may be performed simultaneously during hydraulic fracturing operations.

At block 212, the control system 134 may adjust the total pump rate of the one or more target pumps to the total rate setpoint. When the total pump rate is adjusted, the respective pump rate adjustments for each of the target pumps may be implemented. Accordingly, a rate dip may occur on each of the target pumps, resulting in the total rate dip of the target pumps. In some implementations, the total rate dip may be continuously monitored and determined. In some implementations, the total rate dip may be adjusted based on the continuous monitoring if the total rate dip was estimated prior to hydraulic fracturing operations. With continuous monitoring of the total rate dip, the total rate dip may be adjusted by adding the difference between the measured rate dip and estimated rate dip prior to hydraulic fracturing operations to the rate dip profile (such as the total rate dip 320 of FIG. 3) determined prior to hydraulic fracturing operations. In some implementations, a gain, multiplier, etc. may be applied to the aforementioned difference before adding to the rate dip profile.

At block 214, the control system may adjust the pump rate of the one or more trim pumps to compensate for the total rate dip. The pump rate of the one or more trim pumps may be adjusted to the additional pump rate as described in block 210. The respective pump rate adjustments determined in block 210 may be implemented into the respective trim pumps to generate the additional pump rate of the trim pumps to compensate for the total rate dip. In some implementations, each of the trim pumps may be continuously controlled as the total rate dip is continuously monitored in block 212. For example, when the pump rates of the target pumps are adjusted, generating a rate dip, the total rate dip is determined as the pump rates are adjusted. Accordingly, the respective pump rate adjustments may be determined (as described in block 210) and implemented into each trim pump to compensate for the total rate dip. In some implementations, the total pump rate of the trim pumps may be adjusted to a predetermined pump rate when the total rate dip is estimated prior to hydraulic fracturing operations.

In some implementations, the one or more target pumps and one or more trim pumps may be divided into subsets, where a subset of pumps may include one target pump and one trim pump. The trim pump of a subset may compensate for the rate dip of the corresponding target pump. In some implementations, a subset may include one trim pump and multiple target pumps. In some implementations, a subset may include multiple trim pump and one target pump. The operations described in blocks 212-214 may be sequentially executed for each subset of pumps.

In some implementations, the implementation of the additional pump rate of the trim pumps may be centralized. For example, signals from the target pumps that may indicate the total pump rate of the target pumps and total rate dip of the target pumps may be communicated to the control system 134. Accordingly, the additional pump rate for the trim pumps may be determined to compensate for the total rate dip and communicated to the respective trim pumps. In some implementations, the implementation of the additional pump rate of the trim pumps may be decentralized. For example, hardware may be utilized to measure of pump rates from the target pumps (such as measurements from the encoder of a pump shaft, flow meter, etc.), determine the total rate dip, and/or determine and implement the additional pump rate to the trim pumps to compensate for the total rate dip. Utilizing hardware may reduce the time lag between determination of the total rate dip and mitigation of the total rate dip via the trim pumps.

In some implementations, once one or more target pumps have achieved their respective rate setpoint (i.e., they have shifted gears), they may be treated as trim pumps to other target pumps. For example, once a target pump has shifted to adjust their respective pump rate (as described in block 212), the target pump may then be identified as a trim pump and proceed through operations described in block 206-210 to assist in mitigating rate dip. The process may be repeated until rate dip is mitigated, no more gear shifting of frac pumps is required, and/or the frac pumps reach a steady state.

Example Computer

Figure 5:
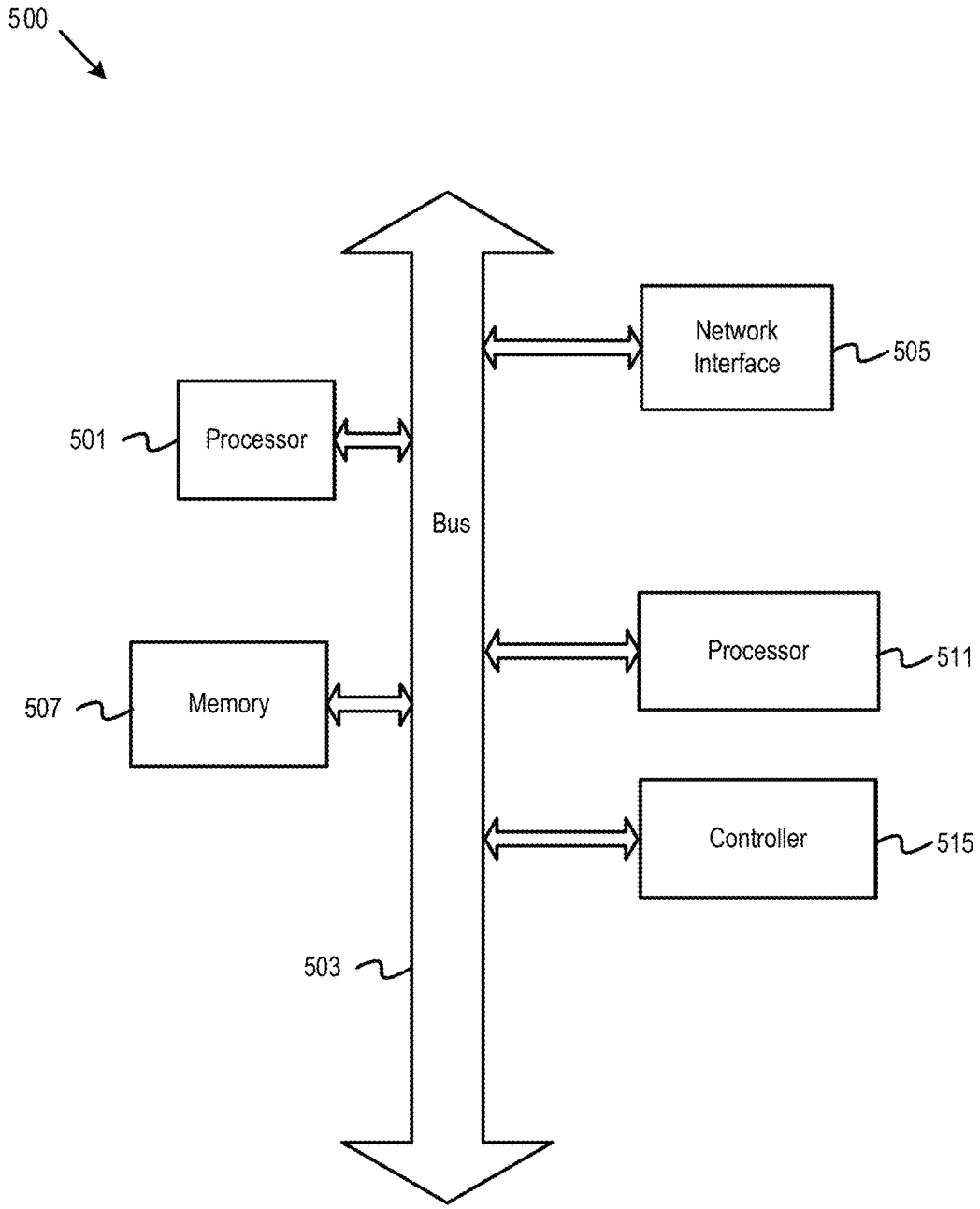
FIG. 5 is a block diagram depicting an example computer, according to some implementations.

FIG. 5 is a block diagram depicting an example computer, according to some implementations. FIG. 5 depicts a computer 500 for preventing rate dips of a fracturing spread. The computer 500 includes a processor 501 (possibly including multiple processors, multiple cores, multiple nodes, and/or implementing multi-threading, etc.). The computer 500 includes memory 507. The memory 507 may be system memory or any one or more of the above already described possible realizations of machine-readable media. The computer 500 also includes a bus 503 and a network interface 505. The computer 500 can communicate via transmissions to and/or from remote devices via the network interface 505 in accordance with a network protocol corresponding to the type of network interface, whether wired or wireless and depending upon the carrying medium. In addition, a communication or transmission can involve other layers of a communication protocol and or communication protocol suites (e.g., transmission control protocol, Internet Protocol, user datagram protocol, virtual private network protocols, etc.).

The computer 500 also includes a processor 511 and a controller 515 which may perform the operations described herein. For example, the processor 511 may identify one or more target pumps and one or more trim pumps. The processor 511 may also determine the rate dip of the one or more target pumps, and determine the additional pump rate of the one or more trim pumps to compensate for the rate dip. The controller 515 may execute one or more actions to mitigate the rate dip. The processor 511 and the controller 515 can be in communication. Any one of the previously described functionalities may be partially (or entirely) implemented in hardware and/or on the processor 501. For example, the functionality may be implemented with an application specific integrated circuit, in logic implemented in the processor 501, in a co-processor on a peripheral device or card, etc. Further, realizations may include fewer or additional components not illustrated in FIG. 5 (e.g., video cards, audio cards, additional network interfaces, peripheral devices, etc.). The processor 501 and the network interface 505 are coupled to the bus 503. Although illustrated as being coupled to the bus 503, the memory 507 may be coupled to the processor 501.

While the aspects of the disclosure are described with reference to various implementations and exploitations, it will be understood that these aspects are illustrative and that the scope of the claims is not limited to them. In general, techniques for mitigating rate dip of a fracturing spread as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein but are to be accorded the widest scope consistent with this disclosure, the principles and the novel features disclosed herein.

Certain features that are described in this specification in the context of separate implementations also may be implemented in combination in a single implementation. Conversely, various features that are described in the context of a single implementation also may be implemented in multiple implementations separately or in any suitable subcombination. Moreover, although features may be described as acting in certain combinations and even initially claimed as such, one or more features from a claimed combination may in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example process in the form of a flow diagram. However, some operations may be omitted and/or other operations that are not depicted may be incorporated in the example processes that are schematically illustrated. For example, one or more additional operations may be performed before, after, simultaneously, or between any of the illustrated operations. In certain circumstances, multitasking and parallel processing may be advantageous. Moreover, the separation of various system components in the implementations described should not be understood as requiring such separation in all implementations, and the described program components and systems may generally be integrated together in a single software product or packaged into multiple software products. Additionally, other implementations are within the scope of the following claims. In some cases, the actions recited in the claims may be performed in a different order and still achieve desirable results.

EXAMPLE IMPLEMENTATIONS

Implementation #1: A method for controlling one or more frac pumps of a fracturing spread, the method comprising: adjusting a total pump rate of one or more target pumps of the frac pumps to achieve a total rate setpoint for the frac pumps; and activating one or more trim pumps for an additional pump rate to compensate for a total rate dip occurring when the total pump rate of the one or more target pumps is adjusted.

Implementation #2: The method of Implementation #1 further comprising: determining a respective rate setpoint for each of the one or more target pumps based on the total rate setpoint; determining a respective rate dip for each of the one or more target pumps; and summing the respective rate dips for each of the one or more target pumps to determine the total rate dip.

Implementation #3: The method of Implementation #1 or #2, wherein the one or more target pumps are pumps that require a gear shift to adjust pump rate of the respective pumps.

Implementation #4: The method of any one or more of Implementation #1-3 further comprising: determining a respective rate adjustment profile for each of the one or more trim pumps based on the total rate dip.

Implementation #5: The method of any one or more of Implementation #1-4, wherein the one or more trim pumps are pumps that do not require a gear shift to adjust pump rate of the respective pumps, and wherein the one or more trim pumps are a part of the one or more frac pumps or specialized pumps utilized for trimming purposes only.

Implementation #6: The method of any one or more of Implementation #1-5, wherein the one or more trim pumps are selected based on pump type and historical performance.

Implementation #7: The method of any one or more of Implementation #1-6 further comprising: determining the total rate dip while adjusting the total pump rate of the one or more target pumps; and adjusting the additional pump rate of the one or more trim pumps while adjusting the total pump rate of the one or more target pumps to compensate for the total rate dip.

Implementation #8: The method of any one or more of Implementation #1-7 further comprising: estimating the total rate dip of the one or more target pumps prior to adjusting the total pump rate of the one or more target pumps; and determining the additional pump rate of the one or more trim pumps to compensate for the total rate dip.

Implementation #9: A non-transitory, computer-readable medium having instructions stored thereon that are executable by a processor to perform operations comprising: determining a total rate setpoint for a fracturing spread configured to hydraulically fracture a subsurface formation, wherein the fracturing spread includes one or more frac pumps; identifying one or more target pumps from the one or more frac pumps, wherein a total pump rate of the one or more target pumps is adjusted to achieve the total rate setpoint; determining a total rate dip for the one or more target pumps; identifying one or more trim pumps from the one or more frac pumps, wherein an additional pump rate of the one or more trim pumps compensates for the total dip rate generated by the one or more target pumps; activating the one or more target pumps to adjust the total pump rate; and activating the one or more trim pumps for the additional pump rate to compensate for the total rate dip when the one or more target pumps are activated.

Implementation #10: The non-transitory, computer-readable medium of Implementation #9 further comprising: determining a respective rate setpoint for each of the one or more target pumps based on the total rate setpoint; determining a respective rate dip for each of the one or more target pumps; and summing the respective rate dips for each of the one or more target pumps to determine the total rate dip.

Implementation #11: The non-transitory, computer-readable medium of Implementation #9 or #10, wherein the one or more target pumps are pumps that require a gear shift to adjust pump rate of the respective pumps.

Implementation #12: The non-transitory, computer-readable medium of any one or more of Implementation #9-11 further comprising: determining a respective rate adjustment profile for each of the one or more trim pumps based on the total rate dip.

Implementation #13: The non-transitory, computer-readable medium of any one or more of Implementation #9-12, wherein the one or more trim pumps are pumps that do not require a gear shift to adjust pump rate of the respective pumps, and wherein the one or more trim pumps are a part of the one or more frac pumps or specialized pumps utilized for trimming purposes only.

Implementation #14: The non-transitory, computer-readable medium of any one or more of Implementation #9-13, wherein the one or more trim pumps are selected based on pump type and historical performance.

Implementation #15: The non-transitory, computer-readable medium of any one or more of Implementation #9-14 further comprising: determining the total rate dip while adjusting the total pump rate of the one or more target pumps; and adjusting the additional pump rate of the one or more trim pumps while adjusting the total pump rate of the one or more target pumps to compensate for the total rate dip.

Implementation #16: The non-transitory, computer-readable medium of any one or more of Implementation #9-15 further comprising: estimating the total rate dip of the one or more target pumps prior to adjusting the total pump rate of the one or more target pumps; and determining the additional pump rate of the one or more trim pumps to compensate for the total rate dip.

Implementation #17: A system comprising: one or more frac pumps of a fracturing spread, wherein the fracturing spread is configured to hydraulically fracture a subsurface formation; a processor; and a computer-readable medium having instructions stored thereon that are executable by the processor to cause the processor to, determine a total rate setpoint for the fracturing spread; identify one or more target pumps from the one or more frac pumps, wherein a total pump rate of the one or more target pumps is adjusted to achieve the total rate setpoint; determine a total rate dip for the one or more target pumps; identify one or more trim pumps from the one or more frac pumps, wherein an additional pump rate of the one or more trim pumps compensates for the total dip rate generated by the one or more target pumps; activate the one or more target pumps to adjust the total pump rate; and activate the one or more trim pumps for the additional pump rate to compensate for the total rate dip when the one or more target pumps are activated.

Implementation #18: The system of Implementation #17 further comprising: determining a respective rate setpoint for each of the one or more target pumps based on the total rate setpoint; determining a respective rate dip for each of the one or more target pumps; and summing the respective rate dips for each of the one or more target pumps to determine the total rate dip.

Implementation #19: The system of Implementation #17 or #18, wherein the one or more target pumps are pumps that require a gear shift to adjust pump rate of the respective pumps.

Implementation #20: The system of any one or more of Implementation #17-19, wherein the one or more trim pumps are pumps that do not require a gear shift to adjust pump rate of the respective pumps, and wherein the one or more trim pumps are a part of the one or more frac pumps or specialized pumps utilized for trimming purposes only.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

The invention claimed is:

1. A method for controlling two or more frac pumps of a fracturing spread, the method comprising:

obtaining a total rate setpoint for the fracturing spread;

identifying one or more target pumps of the frac pumps;

determining a total pump rate adjustment of the one or more target pumps of the frac pumps to achieve the total rate setpoint for the frac pumps;

determining a total rate dip aggregated across the one or more target pumps associated with the total pump rate adjustment; identifying one or more trim pumps of the frac pumps configured to compensate for the total rate dip; and activating the one or more trim pumps of the frac pumps in response to the aggregated total rate dip, wherein the one or more trim pumps are continuously controlled as the aggregated total rate dip is continuously monitored.

2. The method of claim 1 further comprising:

determining a respective rate setpoint for each of the one or more target pumps based on the total rate setpoint;

determining a respective rate dip for each of the one or more target pumps; and summing the respective rate dips for each of the one or more target pumps to determine the total rate dip.

3. The method of claim 1, wherein the one or more target pumps are pumps that require a gear shift to adjust pump rate of the respective pumps.

4. The method of claim 1 further comprising:

determining a respective rate adjustment profile for each of the one or more trim pumps based on the total rate dip.

5. The method of claim 1, wherein the one or more trim pumps are pumps that do not require a gear shift to adjust pump rate of the respective pumps, and wherein the one or more trim pumps are a part of the one or more frac pumps or specialized pumps utilized for trimming purposes only.

6. The method of claim 1, wherein the one or more trim pumps are selected based on pump type and historical performance.

7. The method of claim 1 further comprising:

determining the total rate dip while adjusting the total pump rate adjustment of the one or more target pumps; and adjusting an additional pump rate of the one or more trim pumps while adjusting the total pump rate adjustment of the one or more target pumps to compensate for the aggregated total rate dip.

8. The method of claim 1 further comprising:

estimating the total rate dip of the one or more target pumps prior to adjusting the total pump rate adjustment of the one or more target pumps; and determining an additional pump rate of the one or more trim pumps to compensate for the aggregated total rate dip.

* * * * *